US011969060B2

(12) United States Patent
Hayashi

(10) Patent No.: US 11,969,060 B2
(45) Date of Patent: Apr. 30, 2024

(54) SNAP BUTTON

(71) Applicant: YKK Corporation, Tokyo (JP)

(72) Inventor: Daisuke Hayashi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 17/213,944

(22) Filed: Mar. 26, 2021

(65) Prior Publication Data

US 2021/0212415 A1 Jul. 15, 2021

Related U.S. Application Data

(62) Division of application No. 15/758,525, filed as application No. PCT/JP2015/075914 on Sep. 11, 2015, now Pat. No. 10,986,901.

(51) Int. Cl.
*A44B 17/00* (2006.01)
*A44B 1/44* (2006.01)

(52) U.S. Cl.
CPC ..... *A44B 17/0052* (2013.01); *A44B 17/0029* (2013.01); *A44B 17/0035* (2013.01);
(Continued)

(58) Field of Classification Search
CPC ..... A44B 17/0052; A44B 17/0047; A44B 17/0029; A44B 17/007; A44B 17/0076;
(Continued)

(56) References Cited

U.S. PATENT DOCUMENTS 621,541 A 3/1899 Richardson
1,516,872 A * 11/1924 White ..... A44B 1/44 79/2

(Continued)

FOREIGN PATENT DOCUMENTS

CN 103635114 3/2014
DE 2708104 8/1978

(Continued)

OTHER PUBLICATIONS

English Translation JP 2-134011 as produced by https://www.j-platpat.inpit.go.jp/ Aug. 1, 2019 (Year: 2019).

(Continued)

*Primary Examiner* — Robert Sandy
*Assistant Examiner* — Michael S Lee
(74) *Attorney, Agent, or Firm* — Taylor English Duma LLP

(57) ABSTRACT

A snap button can include a snap button body and a fastener connected to the snap button body with a cloth interposed between them, wherein the snap button body includes a button member including a base; and a metal eyelet attached to an inner surface of the base, the inner surface being placed to face the cloth, wherein the button member includes an engaging portion provided on an outer surface opposite to the inner surface of the base, wherein the fastener includes a fastener base and a pin to be swaged, which protrudes from an inner surface of the fastener base, the inner surface being placed to face the cloth, and wherein the eyelet includes a cylindrical portion receiving the pin, the cloth being pierced by the pin, and the pin being swaged on the inner surface of the base of the button member.

6 Claims, 13 Drawing Sheets

(52) U.S. Cl.
CPC ..... *A44B 17/007* (2013.01); *A44B 17/0076* (2013.01); *A44B 1/44* (2013.01); *A44B 17/0005* (2013.01); *A44D 2201/50* (2013.01); *Y10T 24/3613* (2015.01); *Y10T 24/366* (2015.01); *Y10T 24/45927* (2015.01); *Y10T 24/45953* (2015.01)

(58) Field of Classification Search
CPC ..... Y10T 24/3613; Y10T 24/3651; A44D 2201/50
See application file for complete search history.

(56) References Cited

U.S. PATENT DOCUMENTS

| | | | | |
|---|---|---|---|---|
| 1,583,472 | A | 5/1926 | King | |
| 1,664,582 | A * | 4/1928 | Waldes | A44B 17/0088 24/691 |
| 1,761,612 | A | 6/1930 | Carr | |
| 1,782,165 | A | 11/1930 | Ford | |
| 1,826,683 | A * | 10/1931 | Warner | A44B 17/0094 24/690 |
| 1,831,307 | A * | 11/1931 | King | A44B 17/0005 24/689 |
| 1,872,968 | A | 8/1932 | Kimbell | |
| 1,897,936 | A | 2/1933 | Hausner | |
| 1,910,951 | A | 5/1933 | Hayden | |
| 2,018,104 | A * | 10/1935 | White | A44B 1/44 24/95 |
| 2,538,396 | A | 1/1951 | Sutin | |
| 4,197,617 | A | 4/1980 | Appelt | |
| 4,607,415 | A | 8/1986 | Fukuroi | |
| 5,101,541 | A | 4/1992 | Watanabe | |
| 5,490,309 | A | 2/1996 | Velasquez et al. | |
| 5,647,105 | A | 7/1997 | Candotti | |
| 5,685,049 | A | 11/1997 | Wu | |
| 10,986,901 | B2 | 4/2021 | Hayashi | |
| 11,375,776 | B1 * | 7/2022 | Ben-Arie | A44B 1/28 |
| 2012/0297588 | A1 * | 11/2012 | Hasegawa | A44B 17/0005 29/525.07 |
| 2015/0272283 | A1 * | 10/2015 | Chan | A44B 17/0047 24/573.11 |
| 2018/0242696 | A1 * | 8/2018 | Hayashi | A44B 17/0041 |
| 2018/0271227 | A1 | 9/2018 | Hayashi | |

FOREIGN PATENT DOCUMENTS

| | | |
|---|---|---|
| EP | 0470611 | 2/1992 |
| EP | 0733315 | 9/1996 |
| EP | 2361522 | 8/2011 |
| EP | 2514334 | 10/2012 |
| JP | S28008315 | 8/1953 |
| JP | S33013739 | 8/1958 |
| JP | S54004640 | 1/1979 |
| JP | H02134011 | 11/1990 |
| JP | H0443112 | 4/1992 |
| JP | H08266312 | 10/1996 |
| JP | 2007068746 | 3/2007 |
| TW | 201711589 | 4/2017 |
| WO | 2013042232 | 3/2013 |

OTHER PUBLICATIONS

Hayashi, Daisuke; Advisory Action for U.S. Appl. No. 15/758,525, filed Mar. 8, 2018, dated Apr. 23, 2020, 4 pgs.
Hayashi, Daisuke; Corrected Notice of Allowance for U.S. Appl. No. 15/758,525, filed Mar. 8, 2018, datled Mar. 1, 2021, 6 pgs.
Hayashi, Daisuke; Final Office Action for U.S. Appl. No. 15/758,525, filed Mar. 8, 2018, dated Jan. 17, 2020, 22 pgs.
Hayashi, Daisuke; International Preliminary Report on Patentability for PCT/JP2015/075914, filed Sep. 11, 2015, dated Mar. 13, 2018, 11 pgs.
Hayashi, Daisuke; International Search Report and Written Opinion for PCT/JP2015/075914, filed Sep. 11, 2015, dated Dec. 8, 2015, 11 pgs.
Hayashi, Daisuke; Non-Final Office Action for U.S. Appl. No. 15/758,525, filed Mar. 8, 2018, dated Jun. 19, 2020, 10 pgs.
Hayashi, Daisuke; Non-Final Office Action for U.S. Appl. No. 15/758,525, filed Mar. 8, 2018, dated Aug. 5, 2019, 21 pgs.
Hayashi, Daisuke; Notice of Allowance for U.S. Appl. No. 15/758,525, filed Mar. 8, 2018, dated Jan. 4, 2021, 9 pgs.
Hayashi, Daisuke; Requirement for Restriction/Election for U.S. Appl. No. 15/758,525, filed Mar. 8, 2018, dated May 1, 2019, 6 pgs.
YKK Corporation; Extended European Search Report for serial No. 15903639.1, filed Mar. 30, 2018, dated Mar. 8, 2019, 7 pgs.
Crawford, Mark; Article entitled: "Metal to Plastic: Design Flexibility", located at <https:www/asme.org/topics-resources/content/metal-to-plastic-design-flexibility>, accessed on Apr. 2, 2022, 6 pgs.
Du Pont; Design Guide for General Design Principles for DuPont Engineering Polymers, Copyright 2000, 136 pgs.

* cited by examiner

[Fig. 1]
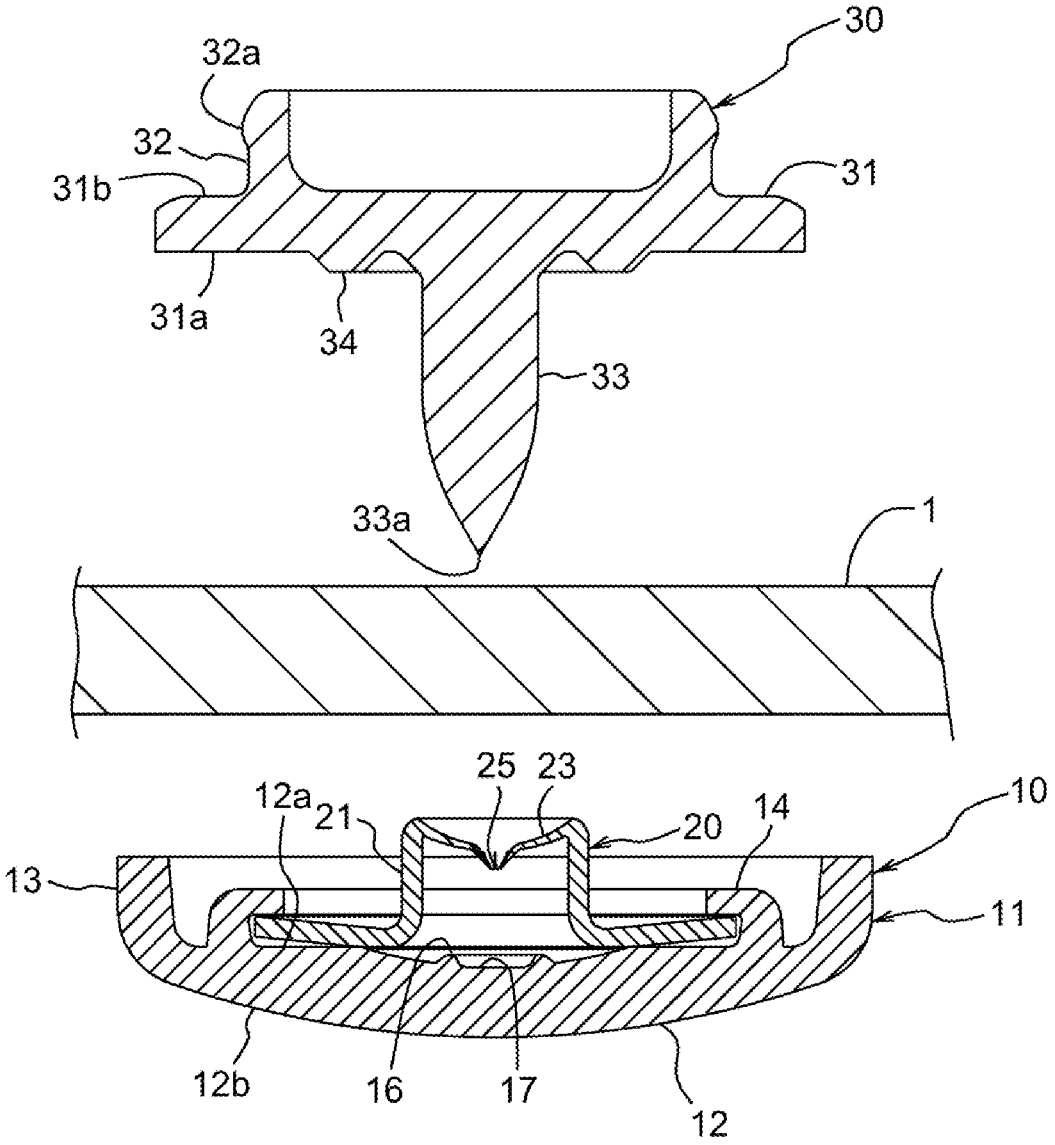

[Fig. 2]
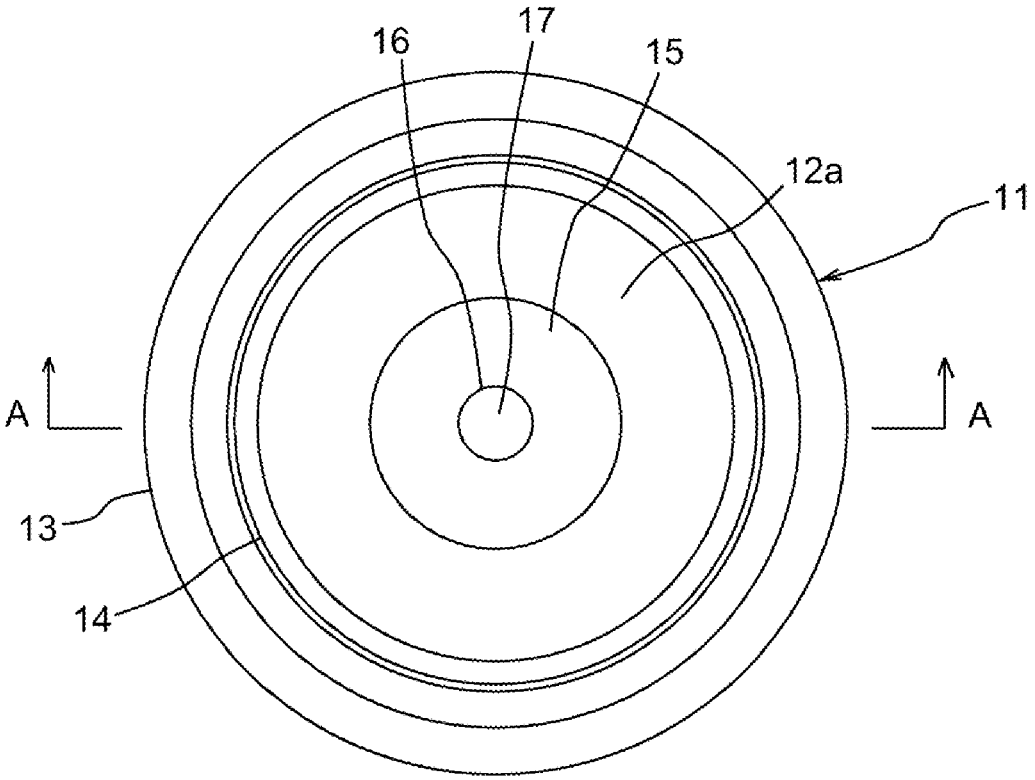

[Fig. 3]
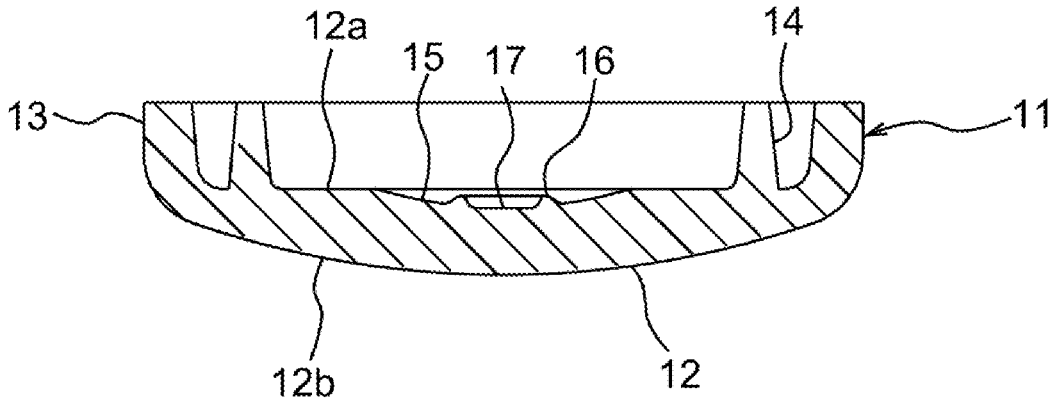

[Fig. 4]
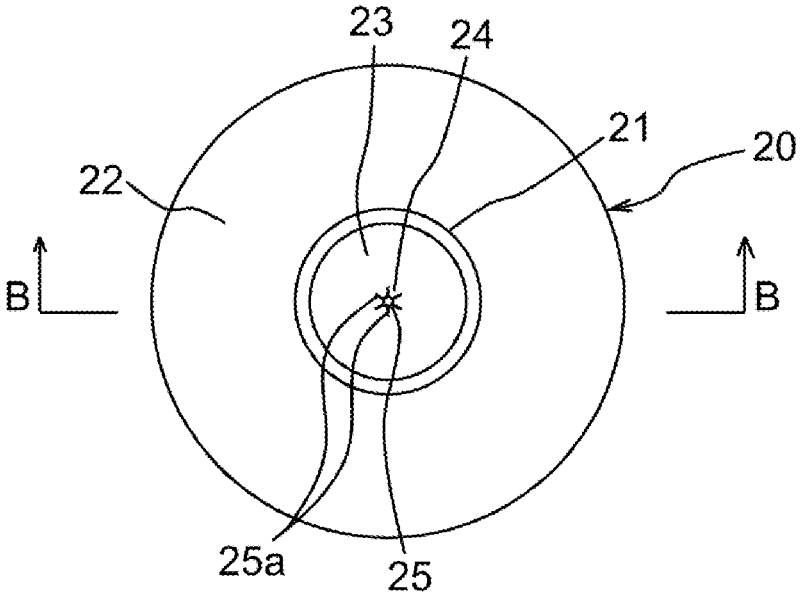

[Fig. 5]
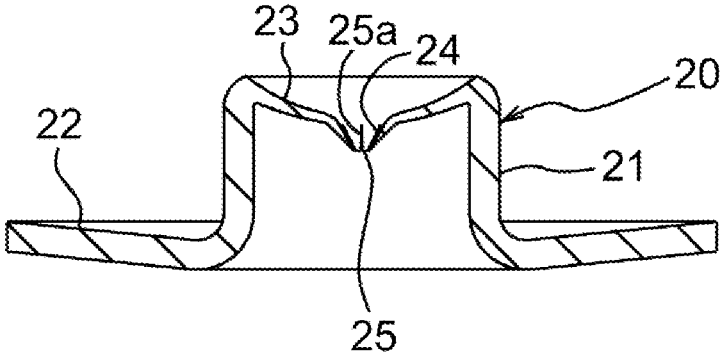

[Fig. 6]
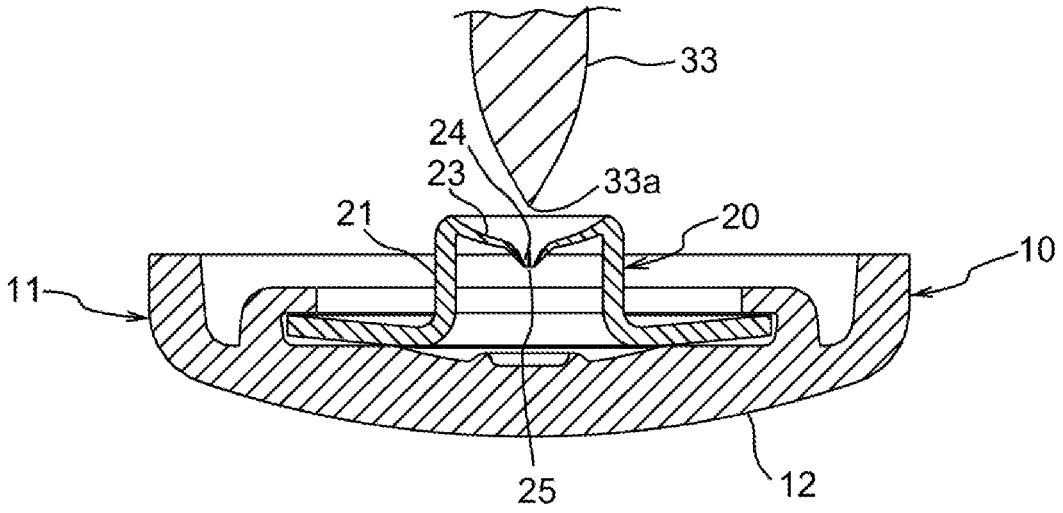

[Fig. 7]
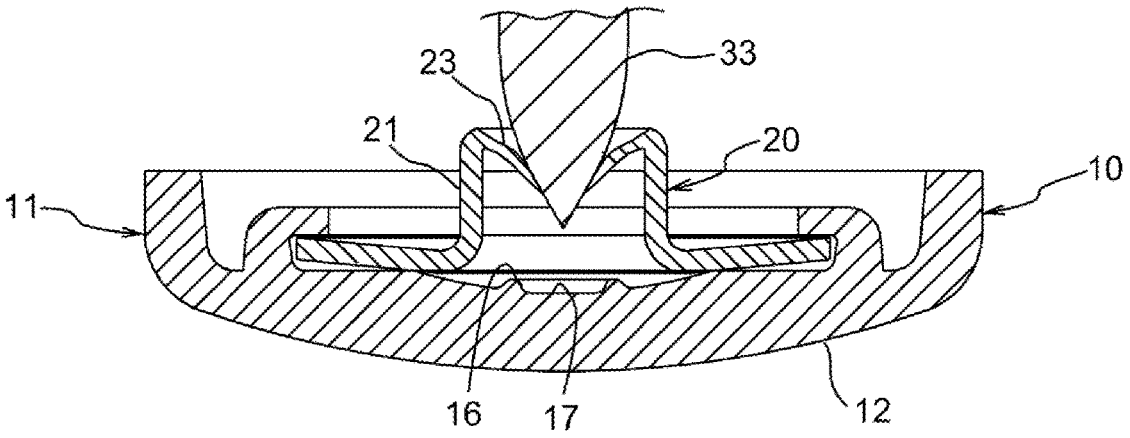

[Fig. 8]
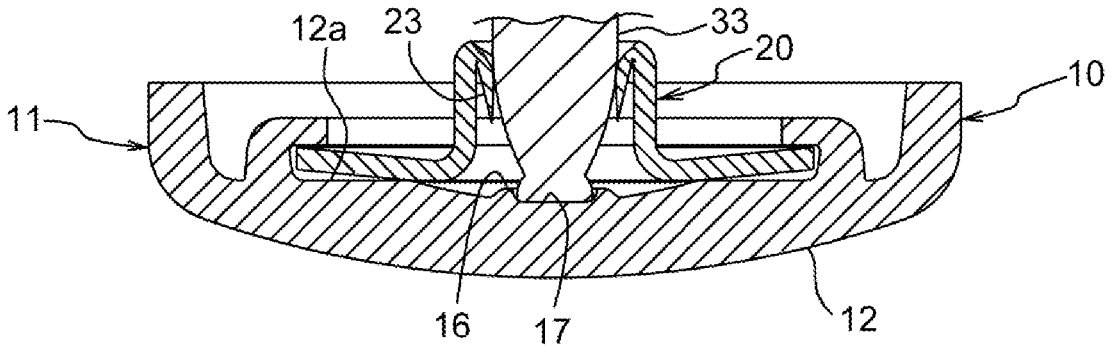

[Fig. 9]
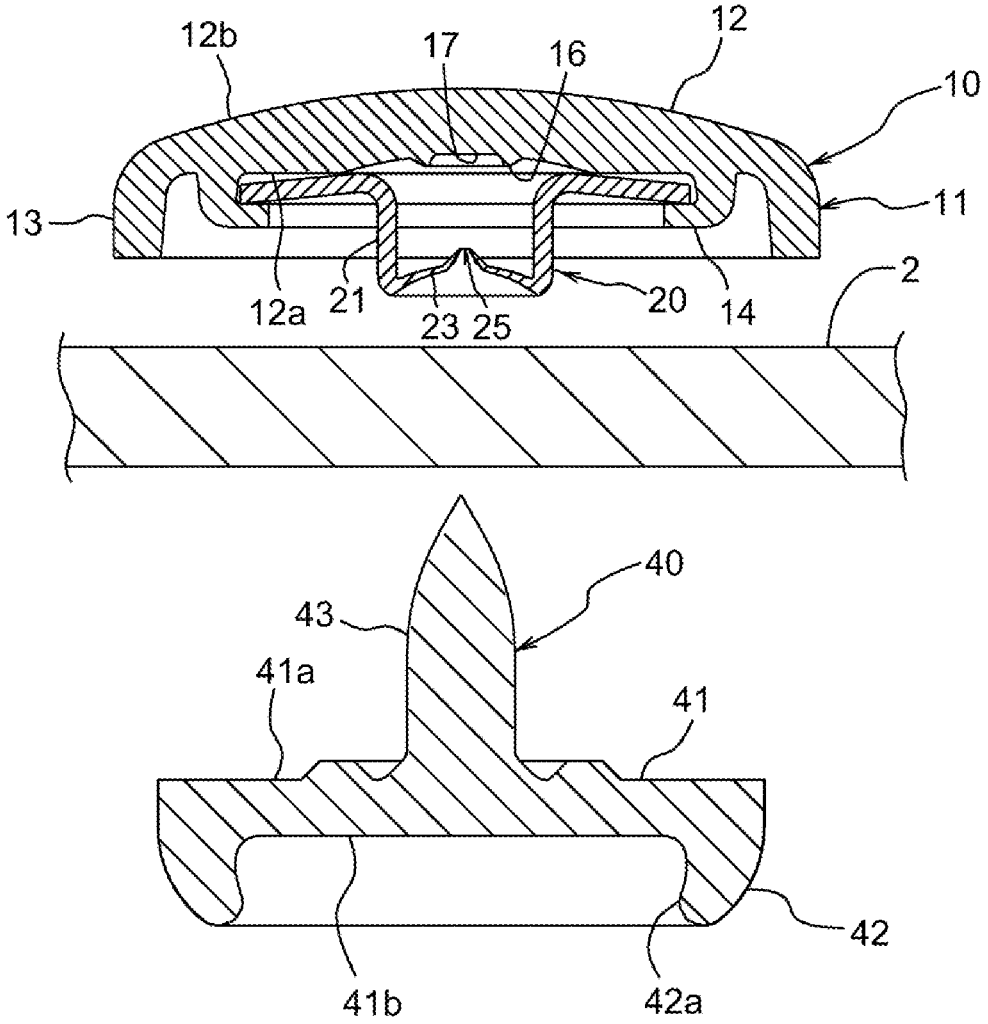

[Fig. 10]
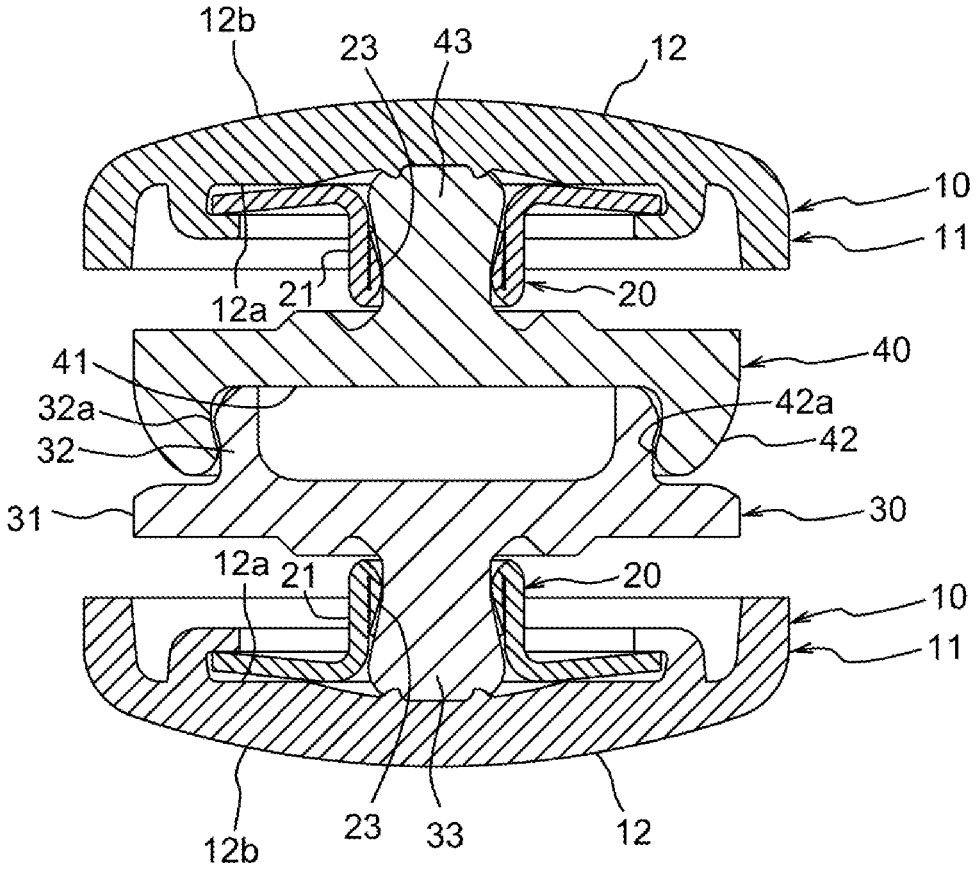

[Fig. 11]
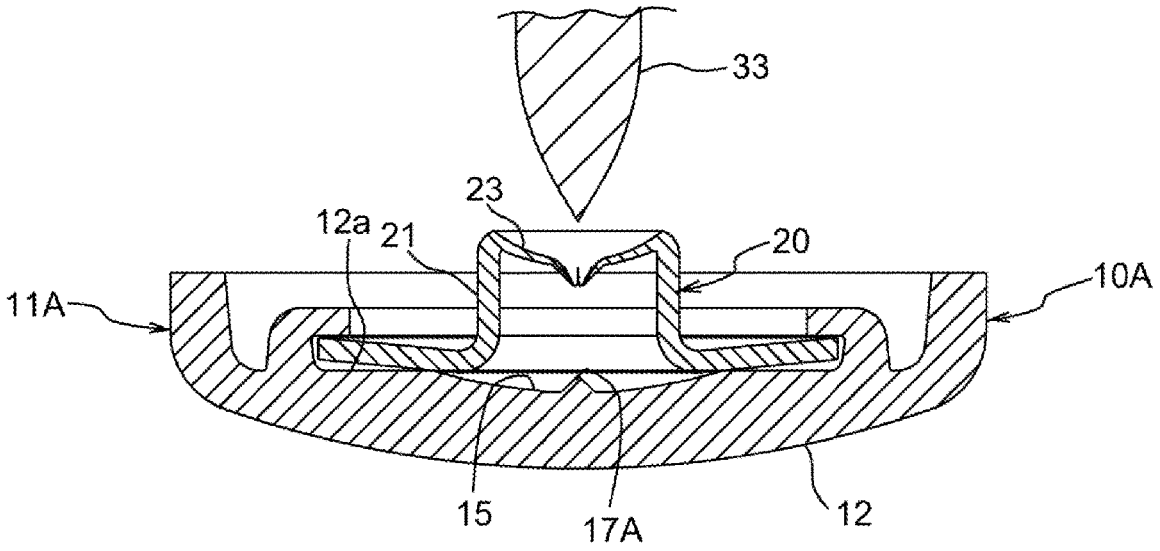

[Fig. 12]
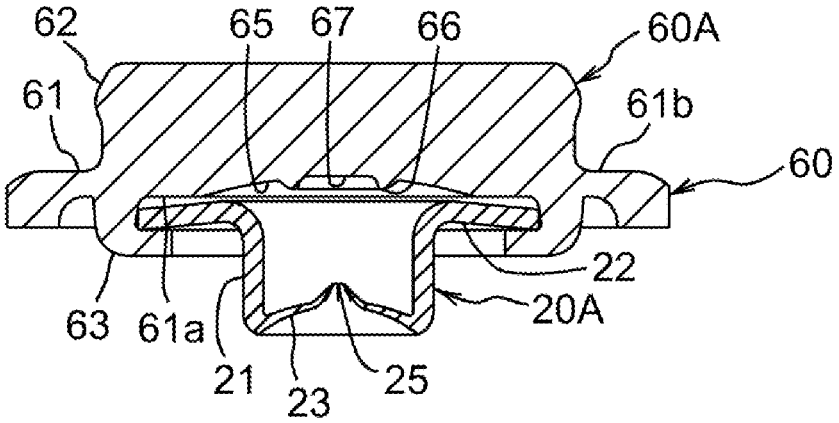
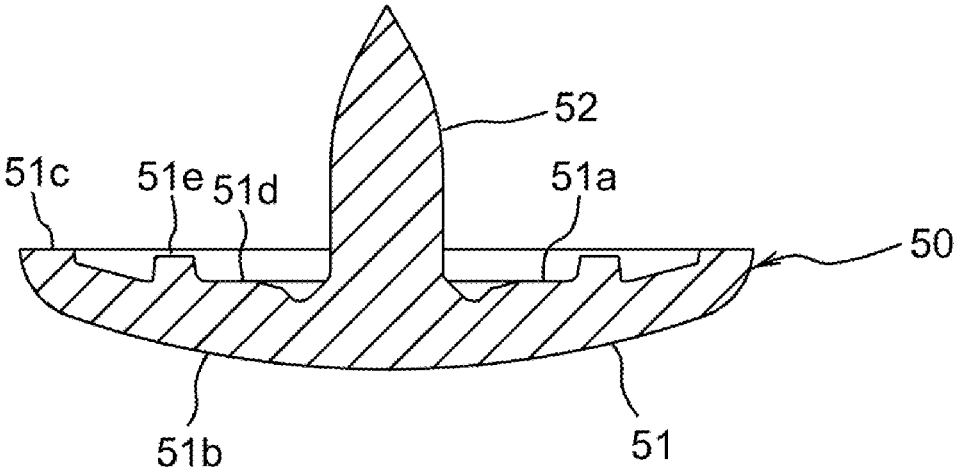

[Fig. 13]
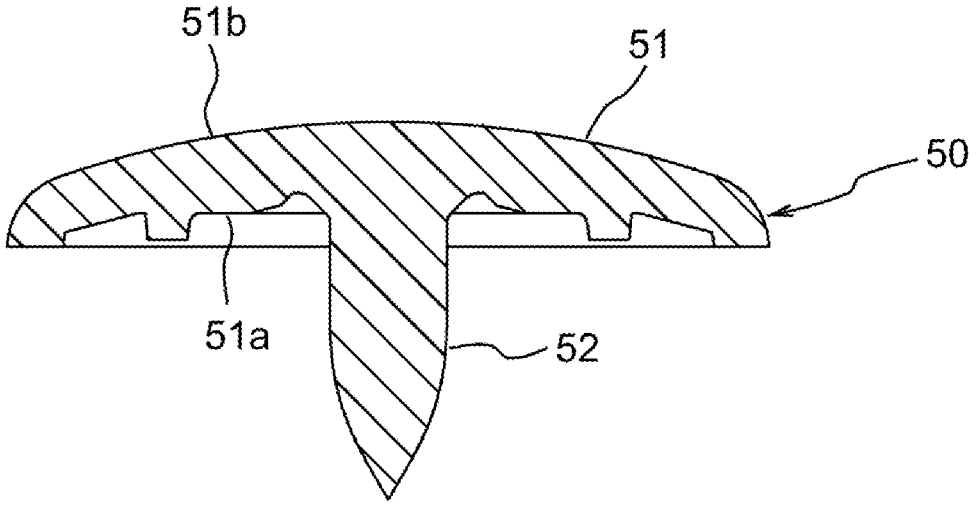
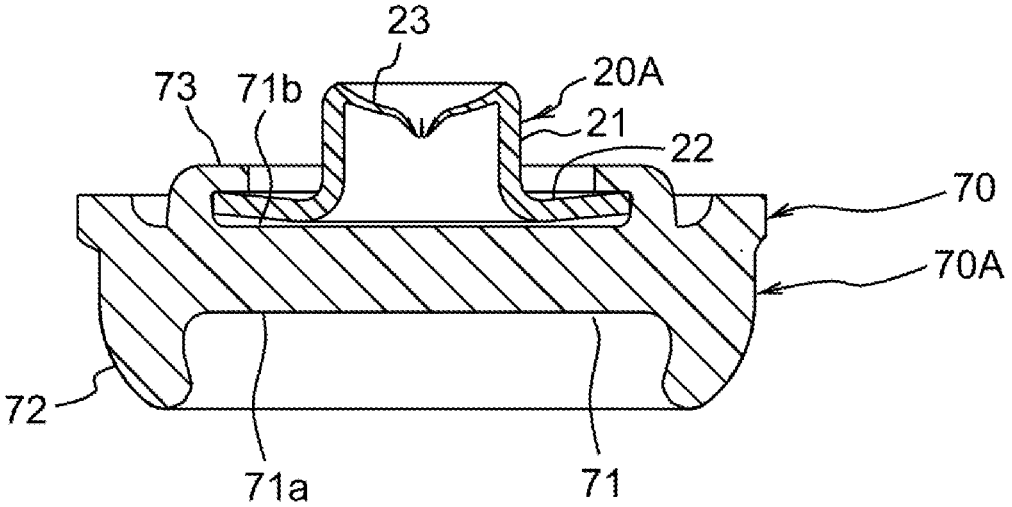

SNAP BUTTON

REFERENCE TO RELATED APPLICATIONS

This application is a divisional of U.S. application Ser. No. 15/758,525, filed Mar. 8, 2018, which is a national stage entry of PCT Application No. PCT/JP2015/075914, filed Sep. 11, 2015, both of which are hereby specifically incorporated by reference herein in their entireties.

BACKGROUND OF THE INVENTION

The present invention relates to a snap button, more particularly to a snap button comprising a male snap button body or a female snap button body and a cap or a fastener, which is connected to the male snap button body or the female snap button body with a cloth interposed between them.

As one type of a snap button, there is known a snap button comprising a resin snap button body and a cap. In the snap button, a to-be-swaged pin is provided in the snap button body, and this pin is swaged on the cap side after it has pierced a cloth. Thereby the snap button body is fixed to the cloth together with the cap. When the snap button is a male snap button, the male snap button body may also be referred to as a stud, and when the snap button is a female snap button, the female snap button body may also be referred to as a socket. The snap button of the above type provides an advantage that it can be designed such that the thickness of the snap button body in the axial direction is thinner than that of a conventional snap button, where a to-be-swaged pin is provided in a fastener, and the pin is swaged on a snap button body side after it has pierced a cloth.

In the snap button of the above type in which the to-be-swaged pin is formed in the snap button body, the to-be-swaged pin that has pierced a cloth is passed through a through-hole of the cap and then swaged in a concave portion on an outer surface (a surface opposite to the surface facing the cloth) of the cap. Therefore, there has been a problem that the swaged portion of the pin appears on the outer surface of the cap and is visible to users in a state where the snap button body and the cap have been attached to the cloth. Thus, there has been a case where such a snap button is not used for fashionable clothing, for example. Further, there has been a case where in a snap button in which a to-be-swaged pin is provided in a fastener, a swaged portion of the to-be-swaged pin may be visible from the outside of the snap button body in a state where the snap button body is attached to a cloth by the fastener.

SUMMARY OF THE INVENTION

The present invention has been made in light of the above problems. An object of the present invention is to provide a snap button in which a swaged portion of a to-be-swaged pin is not visible to users.

To solve the above problems, according to an aspect of the present invention, there is provided a snap button comprising a snap button body and a cap to be connected to the snap button body with a cloth interposed between them, wherein the snap button body comprises a base; a pin to be swaged, which protrudes from an inner surface of the base, the inner surface being placed to face the cloth; and an engaging portion provided on an outer surface opposite to the inner surface of the base, wherein the cap comprises a cap body including a cap base; and a metal eyelet attached to an inner surface of the cap base, the inner surface being placed to face the cloth, and wherein the eyelet comprises a cylindrical portion for receiving the pin which has pierced the cloth and swaging the pin on the inner surface of the cap base.

In the present invention, the to-be-swaged pin is provided in the snap button body, and the snap button body is attached to the cloth together with the cap by swaging the pin within the cylindrical portion of the metal eyelet, which is attached to the inner surface of the cap base of the cap body of the cap, after the pin has pierced the cloth. The eyelet is attached to the inner surface of the cap base, and the inner surface is placed to face the cloth. The pin is swaged on the inner surface of the cap base within the cylindrical portion of the eyelet. Therefore, a swaged portion of the pin does not appear on the outer surface of the cap and is not visible to users, in a state where the snap button body and the cap are attached to the cloth.

The snap button is a male snap button or a female snap button. The engaging portion of the male snap button body and the engaging portion of the female snap button body can be engaged with and disengaged from each other.

In the present invention, in light of ensuring the attachment strength, the eyelet may be made of metal such as, for example and without limitation, aluminum alloy, copper alloy, iron alloy, stainless steel and the like. Further, in the present invention, the snap button body and the cap body may be formed from, for example and without limitation, thermoplastic resin such as nylon, acrylic and ABS, or thermosetting resin such as polyester or the like. When the snap button body and the cap body are made of resin, the metal eyelet attached to the inner surface of the cap base of the cap body is hidden by the cap base and the cloth and is not visible from the outside, in a state where the snap button body and the cap are attached to the cloth. Therefore, to users it can appear as if the snap button body and the cap are made completely of resin.

In one embodiment of the present invention, the eyelet includes a thin wall portion at a cloth-side end of the cylindrical portion, wherein the thin wall portion covers at least a part of an opening of the cylindrical portion and has a thickness thinner than that of a side wall of the cylindrical portion, the thin wall portion being pierced by the pin. The thin wall portion of the cylindrical portion of the eyelet in the cap covers at least a part of the opening at the cloth-side end of the cylindrical portion, and the thickness of the thin wall portion is set to be thinner than the thickness (corresponding to the distance between the inner peripheral surface and the outer peripheral surface of the cylindrical portion) of the peripheral side wall of the cylindrical portion. Such a thin wall portion can be broken through and deformed by the pin of the snap button body, which has pierced the cloth, and then has been brought into contact with the swaged pin. Therefore, the thin wall portion serves to prevent the swaged pin from being easily removed from the cylindrical portion of the eyelet.

In one embodiment of the present invention, the thin wall portion includes a hole at its center. The presence of the hole at the center of the thin wall portion of the eyelet can allow the thin wall portion to be easily broken through from the hole by the pin of the snap button body and to be deformed. Further, by receiving the tip of the pin in the hole at the center of the thin wall portion, the pin can be aligned coaxially with the cylindrical portion of the eyelet.

In one embodiment of the present invention, a depression is formed at a center portion on the inner surface of the cap base. By providing the depression on the inner surface of the cap base of the cap body, the pin of the snap button body, which has broken through the thin wall portion of the eyelet of the cap, will begin to be plastically deformed after the tip of the pin impinges against the depression on the inner surface of the cap base. Therefore, the depression serves to facilitate the pin to be swaged without being biased in the circumferential direction.

In one embodiment of the present invention, a conical projection is formed at a center portion on the inner surface of the cap base of the cap body. By providing the conical projection at the center portion on the inner surface of the cap base of the cap body, the pin of the snap button body, which has broken through the thin wall portion of the eyelet of the cap, will begin to be plastically deformed after the tip of the pin impinges against the conical projection on the inner surface of the cap base. Therefore, the projection serves to facilitate the pin to be swaged without being biased in the circumferential direction.

According to another aspect of the present invention, there is provided a snap button comprising a snap button body and a fastener connected to the snap button body with a cloth interposed between them, wherein the snap button body comprises a button member including a base; and a metal eyelet attached to an inner surface of the base, the inner surface being placed to face the cloth, wherein the button member comprises an engaging portion provided on an outer surface opposite to the inner surface of the base, wherein the fastener comprises a fastener base and a pin to be swaged, which protrudes from an inner surface of the fastener base, the inner surface being placed to face the cloth, and wherein the eyelet comprises a cylindrical portion for receiving the pin which has pierced the cloth and swaging the pin on the inner surface of the base of the button member.

In the present invention, the to-be-swaged pin is provided in the fastener and the snap button body is attached to the cloth together with the fastener by swaging the pin within the cylindrical portion of the metal eyelet, which is attached to the inner surface of the base of the snap button body, after the pin has pierced the cloth. The eyelet is attached to the inner surface of the base of the button member of the snap button body, and the inner surface is placed to face the cloth. The pin is swaged on the inner surface of the base of the button member within the cylindrical portion of the eyelet. Therefore, a swaged portion of the pin does not appear on the outer side of the snap button body and is not visible to users, in a state where the snap button body and the fastener are attached to the cloth.

In the present invention, in light of ensuring the attachment strength, the eyelet may be made of metal such as, for example and without limitation, aluminum alloy, copper alloy, iron alloy, stainless steel and the like. Further, in the present invention, the button member and the fastener may be formed from, for example and without limitation, thermoplastic resin such as nylon, acrylic and ABS, or thermosetting resin such as polyester or the like. When the button member and the fastener are made of resin, the metal eyelet attached to the inner surface of the base of the snap button body is hidden by the base and the cloth and is not visible from the outside, in a state where the snap button body and the fastener are attached to the cloth. Therefore, to users it can appear as if the snap button body and the cap are made completely of resin.

In one embodiment of the present invention, the eyelet includes a thin wall portion at a cloth-side end of the cylindrical portion, wherein the thin wall portion covers at least a part of an opening of the cylindrical portion and has a thickness thinner than that of a side wall of the cylindrical portion, the thin wall portion being pierced by the pin. The thin wall portion of the cylindrical portion of the eyelet in the snap button body covers at least a part of the opening at the cloth-side end of the cylindrical portion, and the thickness of the thin wall portion is set to be thinner than the thickness (corresponding to the distance between the inner peripheral surface and the outer peripheral surface of the cylindrical portion) of the peripheral side wall of the cylindrical portion. Such a thin wall portion can be broken through and deformed by the pin of the fastener, which has pierced the cloth, and then brought into contact with the swaged pin. Therefore, the thin wall portion serves to prevent the swaged pin from being easily removed from the cylindrical portion of the eyelet.

In one embodiment of the present invention, the thin wall portion includes a hole at its center. The presence of the hole at the center of the thin wall portion of the eyelet can allow the thin wall portion to be easily broken through from the hole by the pin of the fastener and to be deformed. Further, by receiving the tip of the pin in the hole at the center of the thin wall portion, the pin can be aligned coaxially with the cylindrical portion of the eyelet.

In one embodiment of the present invention, a depression is formed at the center portion on the inner surface of the base of the button member. By providing the depression on the inner surface of the base of the button member, the pin of the fastener, which has broken through the thin wall portion of the eyelet of the snap button body, will begin to be plastically deformed after the tip of the pin impinges against the depression on the inner surface of the base of the button member. Therefore, the depression serves to facilitate the pin to be swaged without being biased in the circumferential direction.

In one aspect of the present invention, by swaging the pin provided in the snap button body inside the cylindrical portion of the metal eyelet attached to the inner surface of the cap base of the cap body of the cap after the pin has pierced the cloth, a swaged portion of the pin does not appear on the outer surface of the cap and is not visible to users, in a state where the snap button body and the cap are attached to the cloth.

In another aspect of the present invention, by swaging the pin provided in the fastener inside the cylindrical portion of the metal eyelet attached to the inner surface of the base of the snap button body after the pin has pierced the cloth, a swaged portion of the pin does not appear on the outer surface of the snap button body and is not visible to users, in a state where the snap button body and the fastener are attached to the cloth.

BRIEF DESCRIPTION OF THE DRAWINGS

FIG. 1 is a cross-sectional view showing an arrangement configuration immediately before a male snap button as a snap button according to an embodiment of the present invention is attached to a cloth;

FIG. 2 is a top view of a cap body before an eyelet is assembled thereto;

FIG. 3 is a cross-sectional view taken along the line A-A of FIG. 2;

FIG. 4 is a top view of the eyelet;

FIG. 5 is a cross-sectional view taken along the line B-B of FIG. 4;

FIG. 6 is a cross-sectional view showing a state where a pin of a male snap button body is approaching an eyelet of a cap in a step of attaching the male snap button to a cloth;

FIG. 7 is a cross-sectional view showing a state where the pin of the male snap button body is breaking through a thin wall portion of the eyelet of the cap in a step of attaching the male snap button to a cloth;

FIG. 8 is a cross-sectional view showing a state where the tip of the pin of the male snap button body impinges against a depression on an inner surface of the cap base of the cap, and undergoes plastic deformation in a step of attaching the male snap button to a cloth;

FIG. 9 is a cross-sectional view showing an arrangement configuration immediately before a female snap button as a snap button according to another embodiment of the present invention is attached to a cloth;

FIG. 10 is a cross-sectional view showing a state where a male snap button and a female snap button are engaged with each other, in which a cloth is omitted;

FIG. 11 is a cross-sectional view showing a variation of a cap, shown together with the tip of a pin of a male body;

FIG. 12 is a cross-sectional view of another embodiment of a male snap button; and FIG. 13 is a cross-sectional view of another embodiment of a female snap button.

DETAILED DESCRIPTION OF THE INVENTION

Hereinafter, some embodiments of the present invention will be described with reference to the drawings. However, the present invention is not limited to such embodiments and may be suitably altered or modified within the scope of the claims and their equivalents. FIG. 1 is a cross-sectional view showing an arrangement configuration immediately before attaching a male snap button as a snap button according to an embodiment of the present invention, to a cloth 1. The male snap button comprises a male snap button body (hereinafter, also simply referred to as "male body") 30, which is also called a stud; and a cap 10. Hereinafter, the up-and-down direction of the male body 30 and the cap 10 is based on the plane of FIG. 1. The male body 30 is a resin molded product and includes a disk-shaped base 31; an annular, male engaging portion 32 protruding upward from an outer surface 31*b* of the base 31 concentrically with the base 31; and a solid pin 33 to be swaged, which protrudes downward from a center of an inner surface 31*a* of the base 31 concentrically with the base 31. The inner surface 31*a* of the base 31 is a surface which will be placed to face the cloth 1 when the male body 30 is attached to the cloth 1. The male engaging portion 32 can be engaged with and disengaged from a female engaging portion 42 (or an engaging portion of the conventional female snap button body) of a female snap button body 40 according to one embodiment of the present invention as will described below. The male engaging portion 32 includes an enlarged diameter portion 32*a*, the outer diameter of which is slightly enlarged at an upper side on the outer peripheral surface of the male engaging portion 32. The outer diameter of the male engaging portion 32 is enlarged in the enlarged diameter portion 32*a* and then gradually reduced to the upper end.

An outer diameter of the pin 33 of the male body 30 is substantially constant in the upper half and gradually decreases toward the tip (the lower end) in the lower half, forming a sharp tip 33*a*. An annular convex portion 34 slightly protruding downward is provided around a proximal end (upper end) of the pin 33 on the inner surface 31*a* of the base 31. The region between the annular convex portion 34 and the proximal end of the pin 33 is relatively recessed upward. The annular convex portion 34 serves as a stopper of rotation of the male body 30 on the cloth 1 by pushing the cloth 1 against the cap 10 when the male body 30 is attached to the cloth 1 together with the cap 10 as will be described below. In the male body 30, the to-be-swaged pin 33 for attaching the male body 30 itself to the cloth 1 is provided in the male body 30 in place of the cap 10, so that the thickness of the male body as attached to the cloth 1, namely, the distance from the inner surface 31*a* of the base 31 to the upper end of the male engaging portion 32 can be designed to be as thin as possible. In the male body 30, the protruding length of the male engaging portion 32 from the base 31 is shorter than the protruding length of the pin 33 from the base 31. As will be described below in detail, the male body 30 is fixed to the cloth 1 by swaging the pin 33 that has downwardly pierced the cloth 1, on the cap 10 side.

The cap 10 comprises a cap body 11, which is a resin molded product; and an eyelet which is a metal part to be assembled to the cap body 11. FIG. 2 is a top view of the cap body 11 before the eyelet 20 is assembled, and FIG. 3 is a cross-sectional view taken along the line A-A of FIG. 2. The cap body 11 includes a disk-shaped cap base 12; an annular peripheral side portion 13 extending upward from a radially outer end of the cap base 12; and an annular projection 14 protruding upward from an inner surface 12*a* of the cap base 12 slightly radially inward than the peripheral side portion 13. The inner surface 12*a* of the cap base 12 is a surface which will be placed to face the cloth 1, 2 in the cap base 12 when the cap 10 is attached to the cloth 1, 2. The annular projection 14 is a portion to be swaged as described below in order to fix the eyelet 20 to the cap body 11. The peripheral side portion 13 and the annular projection 14 have the same height. The thickness of the annular projection 14 in the radial direction is designed to be gradually thinner upward slightly. Therefore, the annular projection 14 can be easily swaged when the eyelet 20 is fixed. An outer surface 12*b* of the cap base 12 is a spherical surface slightly convex downward and is gently connected to the outer peripheral surface of the peripheral side portion 13. On the outer surface 12*b* of the cap 10, a logo or the like may be applied by printing, engraving or the like. A circular shallow concave portion 15 is formed at a center portion on the inner surface 12*a* of the cap base 12. A portion radially inward from the annular projection 14 and radially outward from the concave portion 15 on the inner surface 12*a* is a horizontal surface perpendicular to the axis of the cap body 11. On the concave portion 15, an annular small raised portion 16 is provided, which slightly protrudes upward. The concave portion 15 is slightly gradually deepened from its radially outer end toward the small raised portion 16, and a circular depression 17 is defined radially inward from the small raised portion 16. That is, the depression 17 is defined by the side surface facing radially inward of the small raised portion 16 and the horizontal bottom surface radially inward from the small raised portion 16 on the inner surface 12*a* of the cap base 12. It should be understood that the depression is not necessarily circular and may be a polygonal shape such as a quadrangle, a pentagon, and so on with the axis at the center of the cap base 12. The small raised portion 16 protrudes upward and has a substantially triangular cross section along the radial direction. The upper end of the small raised portion 16 is located slightly below the imaginary extension surface flush with the inner surface 12*a* radially outward from the concave portion 15.

FIG. 4 shows a top view of the eyelet 20, and FIG. 5 shows a sectional view taken along the line B-B of FIG. 4. The eyelet 20 is a metal part made of an aluminum alloy, a copper alloy, an iron alloy, stainless steel or the like, and includes a cylindrical portion 21 or a tube portion; a plate-shaped flange portion 22 extending radially outward from the lower end of the cylindrical portion 21; and a thin wall portion 23 obliquely extending radially inward and downward from the upper end of the cylindrical portion 21. The thin wall portion 23 partially covers an upper end opening of the cylindrical portion 21, which will face the cloth 1. Further, the thickness of the thin wall portion 23 is thinner than the thickness of a side wall of the cylindrical portion 21 (namely, the distance between the inner peripheral surface and the outer peripheral surface of the cylindrical portion 21). Furthermore, the thin wall portion 23 is obliquely downward inclined toward the axis of the cylindrical portion 21, so that the upper surface of the thin wall portion 23 has a shape recessed toward the center of the cylindrical portion 21. The diameter of the cylindrical portion 21 is substantially constant. The flange portion 22 extends radially outward from the lower end of the cylindrical portion 21 slightly upward and obliquely. The cylindrical portion 21 and the flange portion 22 have substantially the same constant thickness. The thickness of the thin wall portion 23 gradually decreases from its radially outer end (the upper end of the cylindrical portion 21) to its radially inner end. The thin wall portion 23 has the thickest thickness at the radially outer end, but the thickest portion is thinner than the thickness of the cylindrical portion 21 and the thickness of the flange portion 22. The thin wall portion 23 includes a pin receiving portion 24 at its central region in which an angle inclined downward relative to the horizontal plane is larger than an angle of a region, in the thin wall portion 23, radially outward from the central region. The center of the pin receiving portion 24 opens as a small hole (an opening) 25. Further, the pin receiving portion 24 includes circumferentially a plurality of (six in FIG. 4) notches or slits 25*a*, which extend radially outward from the small hole 25.

FIG. 1 shows the cap 10 with the eyelet 20 assembled to the cap body 11. When the eyelet 20 is attached to the cap body 11, the flange portion 22 of the eyelet 20 is placed on the radially inner side of the annular projection 14 on the inner surface 12*a* of the cap base 12 of the cap body 11, and then the annular projection 14 is swaged by means of a punch (not shown) so as to tilt the annular projection 14 radially inward. Therefore, the flange portion 22 of the eyelet 20 is fixed by the swaged annular projection 14, and the eyelet 20 is secured to the cap body 11. The outer diameter of the flange portion 22 of the eyelet 20 is designed to be slightly smaller than the inner diameter of the annular projection 14 of the cap body 11. When attached to the cap body 11, the eyelet 20 has a height slightly higher than that of the peripheral side portion 13 of the cap body 11. The inner diameter of the cylindrical portion 21 of the eyelet 20 is slightly larger than the diameter of the small raised portion 16 of the cap body 11 and slightly smaller than the diameter of the concave portion 15. The diameter of the annular projection 14 is substantially the same as the maximum outer diameter of the pin 33 of the male body 30.

When the male body 30 is attached to the cloth 1, the male body 30 is lowered from the state of FIG. 1. Here, the male body 30 is held on an upper die of an attachment apparatus (not shown), and the cap 10 is placed on a lower die (not shown). Then, as the upper die is lowered toward the lower die, the male body 30 is lowered. In such a way, the pin 33 of the male body 30 penetrates the cloth 1 downward and then is swaged inside the cylindrical portion 21 of the eyelet 20 of the cap 10 as follows. First, the tip 33*a* of the pin 33 which has pierced the cloth 1 impinges against the pin receiving portion 24 and the small hole 25 of the thin wall portion 23 of the cylindrical portion 21 of the eyelet 20, from the state of FIG. 6. In this case, the pin receiving portion 24 and the small hole 25 serve to align the pin 33 with the cylindrical portion 21 of the eyelet 20. The pin 33 is then inserted into the cylindrical portion 21 of the eyelet 20 so as to break through the thin wall portion 23 from the small hole 25 and the pin receiving portion 24 as shown in FIG. 7. In this case, since the pin receiving portion 24 is provided with the plurality of slits 25*a* radially outward from the center small hole 25 and the thin wall portion 23 is formed to be relatively thin, the thin wall portion 23 is easily broken through and deformed by the pin 33 without affecting the shape of the cylindrical portion 21. The tip 33*a* of the pin 33 then impinges against the depression 17 radially inward from the small raised portion 16 on the inner surface 12*a* of the cap base 12 of the cap 10, which is supported by the lower die (not shown), and the tip 33*a* begins to be plastically deformed, as shown in FIG. 8. In the initial stage of the plastic deformation or swaging, the tip 33*a* of the pin 33 begins to axially crush at the depression 17 surrounded by the small raised portion 16 and then fills the radially inside of the small raised portion 16 (see FIG. 8). The deformation of the pin 33 so as to fill the radially inner region (the depression 17) of the small raised portion 16 in the initial stage of swaging facilitates the pin 33 to be swaged without being biased in the circumferential direction. The pin 33 is then swaged so as to fill the space inside the cylindrical portion 21 of the eyelet 20 (see FIG. 10). As shown in FIG. 10, an outer diameter of the swaged pin 33 increases from its proximal end (upper end) on the base 31 side toward its lower end on the cap base 12 side. Further, the thin wall portion 23 is broken through by the outer peripheral surface of the proximal end portion of the pin 33 having a relatively small diameter, so that the thin wall portion 23 is deformed so as to be close to the inner peripheral surface of the cylindrical portion 21. The deformed thin wall portion 23 reduces the diameter of the upper opening of the cylindrical portion 21, and the tip of the thin wall portion 23 is brought into contact with the pin 33, so that the swaged pin 33 cannot be easily removed from the cylindrical portion 21 of the eyelet 20. Further, since the pin 33 of the male body 30 is swaged inside the cylindrical portion 21 of the eyelet 20 on the inner surface 12*a* side of the cap base 12, the swaged pin 33 does not appear on the outer surface 12*b* side of the cap base 12 and is thus invisible to users. Furthermore, the metal eyelet 20 of the cap 10 is hidden by the cap body 11 and the cloth 1, so it is not visible from the outside, in the state where the male body 30 and the cap 10 are attached to the cloth 1. Therefore, to users it can appear as if the male snap button—comprising the male body 30 and the cap 10—is made completely of resin.

FIG. 9 is a cross-sectional view showing an arrangement configuration immediately before attaching a female snap button as a snap button according to another embodiment of the present invention, to the cloth 2. The snap button comprises a female snap button body (hereinafter, simply referred to as "female body") 40, also called a socket; and a cap 10. Since the cap 10 is the same as the cap 10 described above in connection with the male body 30, the same reference numerals will be used and descriptions thereof will be omitted. Hereinafter, the up-and-down direction of the female body 40 is based on the plane of FIG. 9. The female body 40 is a resin molded product and includes a disk-shaped base 41; an annular female engaging portion 42 protruding downward from an outer surface 41*b* of the base 41 concentrically with the base 41; and a solid pin 43 to be swaged, which protrudes upward from a center portion of an inner surface 41*a* of the base 41 concentrically with the base 41. The inner surface 41*a* of the base 41 is a surface to be placed to face the cloth 2 in the base 41 when the female body 40 is attached to the cloth 2. The female body 40 has substantially the same form as that of the male body 30 except for the female engaging portion 42, and the pin 43 of the female body 40 is substantially the same as the pin 33 of the male body 30. The female engaging portion 42 can be engaged with and disengaged from the male engaging portion 32 (or an engaging portion of a conventional female snap button body) of the male body 30 as described above. The female engaging portion 42 includes a reduced diameter portion 42*a* with its inner diameter slightly reduced, at a lower end on the inner peripheral surface. The inner diameter of the female engaging portion 42 is reduced at the reduced diameter portion 42*a* and then gradually enlarged toward the upper end. The outer diameter of the female engaging portion 42 is gradually reduced toward the lower end. The female body 40 is fixed to the cloth 2 by swaging the pin 43 that has upwardly pierced the cloth 2 within the cylindrical portion 21 of the eyelet 20 of the cap 10. In this case, the pin 43 of the female body 40 is swaged as with the pin 33 of the male body 30 as described above. The pin 43 of the female body 40 is swaged inside the cylindrical portion 21 of the eyelet 20 on the inner surface 12*a* of the cap base 12, so that the swaged pin 43 does not appear on the outer surface 12*b* of the cap base 12 and is not visible to users. Further, the metal eyelet of the cap 10 is hidden by the cap body 11 and the cloth 2 and is not visible from the outside in the state where the female body 40 and the cap 10 are attached to the cloth 2. Therefore, to users it can appear as if the female snap button—comprising the female body and the cap 10—is made completely of resin.

FIG. 10 is a cross-sectional view showing a state where the male snap button and the female snap button as described above are engaged with each other. In this figure, the cloths 1 and 2 are omitted. In this state, the male engaging portion 32 of the male body 30 is coupled to the female engaging portion 42 of the female body 40. In both of the male and female snap buttons, the swaged portions of the respective pins 33, 43 of the male body 30 and the female body 40 are not visible from the outside or users. Further, since the metal eyelet 20 of each cap 10 is also invisible from the outside, the male and female snap buttons can appear as if they are made completely of the resin.

FIG. 11 is a cross-sectional view showing a cap 10A, which is another example of a cap of the snap button according to the present invention, and shows the tip portion of the pin 33 of the male body 30 together, for convenience. The pin shown in FIG. 11 will be described as the pin 33 of the male body 30 but it may be the pin 43 of the female body 40. The cap 10A comprises a cap body 11A and an eyelet 20. Since the eyelet 20 is the same as the eyelet 20 of the cap 10 as described above, the same reference numerals are used and descriptions thereof are omitted. The cap body 11A is different from the cap body 11 in the following point: the cap body 11A is not provided with the annular small raised portion 16 and the depression 17 in the concave portion 15 formed on the inner surface 12*a* of the cap base 12, and alternatively it is provided with a conical projection 17A slightly protruding upward at the center in the concave portion 15. With regard to the cap body 11A, the same reference numerals as those of the cap body 11 are used except for the projection 17A, and descriptions thereof are omitted. The top of the projection 17A is positioned slightly below the imaginary extension plane flush with the inner surface 12*a* radially outward from the concave portion 15. When the male body 30 is attached to the cloth (not shown) using the cap 10A, the pin 33 of the male body 30, which has pierced the cloth breaks through the thin wall portion 23 of the eyelet 20 and goes into the cylindrical portion 21. Then, the tip 33*a* of the pin 33 impinges against the projection 17A and begins to undergo plastic deformation. The projection 17A assists the swaging of the pin 33 without being biased in the circumferential direction. In addition, the projection 17A may be provided together with the depression 17 in the above-mentioned embodiment. That is, the conical projection 17A may be provided at the center of the depression 17.

In the above-described embodiments, the to-be-swaged pin 33, 43 is provided in the snap button body 30, 40 and the metal eyelet 20 is attached to the cap 10. However, the present invention is not limited to such embodiments, and a to-be-swaged pin may be provided in a fastener and an eyelet may be provided in a snap button body, as will be described below. FIG. 12 is a cross-sectional view of a male snap button as a snap button according to yet another embodiment of the present invention. The male snap button comprises a male snap button body (a male body) 60 and a fastener 50 made of resin. The male body 60 comprises a male button member (hereinafter, referred to as "male member") 60A made of resin; and a metal eyelet 20A. Hereinafter, the up-and-down direction of the male body 60 and the fastener 50 is based on the plane of FIG. 12. The fastener 50 includes a disk-shaped fastener base 51 and a pin 52 to be swaged, which protrudes upward from an inner surface 51*a* of the fastener base 51. The inner surface 51*a* of the fastener base 51 will be placed to face a cloth when the male body 60 is attached to the cloth. An outer surface 51*b* of the fastener base 51 is slightly convex spherical. The inner surface 51*a* of the fastener base 51 includes an outer annular surface 51*c* at a radially outer end, the outer annular surface 51*c* being along the horizontal plane; a concave portion 51*d* radially inward from the outer annular surface 51, the concave portion 51*d* being recessed below the outer annular surface 51*c*; and an annular raised portion 51*e* protruding upward in approximately the middle between the proximal end (lower end) of the pin 52 and the outer annular surface 51*c*. The concave portion 51*d* is deepest at a region adjacent to the proximal end of the pin 52 and is gradually shallower from the annular raised portion 51*e* to the outer annular surface 51*c*. The annular raised portion 51*e* has a rectangular cross section, and the horizontal top surface of the annular raised portion 51*e* is positioned slightly below the imaginary extension plane from the outer annular surface 51*c*.

The male member 60A includes a disk-shaped base 61; a solid male engaging portion 62 protruding upward from an outer surface 61*b* of the base 61; and an annular projection 63 for fixing the eyelet 20A, which is provided on an inner surface 61*a* of the base 61. The radially inner region of the annular projection 63 on the inner surface 61*a* of the base 61 has substantially the same form as that on the inner surface 12*a* of the cap base 12 of the cap 10 as described above. That is, the inner surface 61*a* of the base 61 is provided with a concave portion 65, and the concave portion 65 is provided with an annular small raised portion 66, with a circular depression 67 radially inward from the small raised portion 66. The eyelet 20A has substantially the same configuration as the eyelet 20 but their sizes are different from each other. Therefore, the same reference numerals as those of the eyelet will be used. That is, the eyelet 20A includes the cylindrical portion 21, the flange portion 22 and the thin wall portion 23, and the thin wall portion 23 includes the pin receiving portion and the small hole with slits formed. When the eyelet 20A is attached to the male member 60A, the eyelet 20A is disposed on the radially inner region of the annular projection 63 in the inner surface 61*a* of the base 61 of the male member 60A and the annular projection 63 is then swaged radially inward. The eyelet 20A is thus fixed to the male member 60A. The male body 60 is fixed to a cloth (not shown) by swaging the pin 52 of the fastener 50, which has pierced the cloth upward, within the cylindrical portion 21 of the eyelet 20A of the male body 60. In this case, the pin 52 of the fastener 50 is swaged substantially in the same manner as the pin 33 of the male body 30 as described above. Since the pin 52 of the fastener 50 is swaged inside the cylindrical portion 21 of the eyelet 20A on the inner surface 61*a* of the base 61 of the male member 60A, the swaged pin 52 does not appear on the outer surface 61*b* of the base 61 and is not visible to users. Furthermore, the metal eyelet 20A in the male body 60 is hidden by the male member 60A and the cloth and is not visible from the outside in the state where the male body 60 and the fastener 50 are attached to the cloth. Therefore, to users it can appear as if the male snap button—comprising the male body 60 and the fastener 50—is made completely of resin.

FIG. 13 is a cross-sectional view of a female snap button as a snap button according to still another embodiment of the present invention. The female snap button comprises a female snap button body (a female body) 70; and a fastener 50 made of resin. Since the fastener 50 is the same as that described above in connection with the male body 60, the same reference numerals will be used and descriptions thereof will be omitted. The female body 70 comprises a female button member (hereinafter, referred to as "female member") 70A made of resin and an eyelet 20A made of metal. Since the eyelet 20A is the same as that described above in connection with the male member 60A of the male body 60, the same reference numerals will be used and descriptions thereof will be omitted. Hereinafter, the up-and-down direction of the female body 70 is based on the plane of FIG. 13. The female member 70A includes a disk-shaped base 71; an annular female engaging portion 72 protruding downward from an outer surface 71*a* of the base 71; and an annular projection 73 for fixing the eyelet 20A, which is provided on an inner surface 71*b* of the base 71. The radially inner region of the annular projection 73 on the inner surface 71*b* of the base 71 is a horizontal plane. When the eyelet 20A is attached to the female member 70A, the eyelet 20A is disposed on the radially inner region of the annular projection 73 on the inner surface 71*a* of the base 71 of the female member 70A and the annular projection 73 is then swaged radially inward. The eyelet 20A is thus fixed to the female member 70A. The female body 70 is fixed to a cloth (not shown) by swaging the pin 52 of the fastener 50, which has pierced the cloth downward, within the cylindrical portion 21 of the eyelet 20A of the female body 70. In this case, the pin 52 of the fastener impinges against the inner surface 71*b* of the base 71 of the female member 70A and is then swaged. Therefore, the swaged pin 52 does not appear on the outer surface 71*a* of the base 71 and is not visible to users. Further, in the state where the female body 70 and the fastener 50 are attached to the cloth, the metal eyelet 20A in the female body 70 is hidden by the female member 70A and the cloth and is not visible from the outside. Therefore, to users it can appear as if the female snap button—comprising the female body and the fastener 50—is made completely of resin.

Reference Signs List

10, 10A cap
11, 11A cap body
12 cap base
12*a* inner surface of the cap base 12
12*b* outer surface of the cap base 12
14 annular projection
15 concave portion
16 small raised portion
17 depression
17A projection
20, 20A eyelet
21 cylindrical portion (tube portion)
22 flange portion
23 thin wall portion
24 pin receiving portion
25 small hole (opening)
25*a* slit (notch)
30 male snap button body (male body)
31 base
31*a* inner surface of the base
31*b* outer surface of the base
32 male engaging portion
33 pin
33*a* tip of the pin
40 female snap button body (female body)
41 base
41*a* inner surface of the base
41*b* outer surface of the base
42 female engaging portion
43 pin
50 fastener
51 fastener base
51*a* inner surface of the fastener base
52 pin
60 male snap button body (male body)
60A male button member
61 base
61*a* inner surface of the base
61*b* outer surface of the base
62 male engaging portion
65 concave portion
66 small raised portion
67 depression
70 female snap button body (female body)
70A female button member
71 base
71*a* outer surface of the base
71*b* inner surface of the base
72 female engaging portion That which is claimed is:

1. A snap button comprising a snap button body and a fastener connected to the snap button body with a cloth interposed between them, wherein the snap button body comprises a button member including a base; and a metal eyelet attached to an inner surface of the base, the inner surface being placed to face the cloth, wherein the button member comprises an engaging portion provided on an outer surface opposite to the inner surface of the base, the engaging portion configured to engage with a mating snap button, wherein the fastener comprises a fastener base and a pin to be swaged, which protrudes from an inner surface of the fastener base, the inner surface being placed to face the cloth, wherein the eyelet comprises a cylindrical portion defining a substantially constant diameter, the cloth being pierced by the pin, and the pin being swaged inside the cylindrical portion of the eyelet on the inner surface of the base of the button member, wherein the button member and the fastener are made of resin, and wherein the eyelet is hidden by the base and the cloth and not visible from the outside of the snap button when the fastener is connected to the snap button body.

2. The snap button according to claim 1, wherein the eyelet includes a thin wall portion at a cloth-side end portion of the cylindrical portion, wherein the thin wall portion covers at least a part of an opening of the cylindrical portion and has a thickness thinner than that of a side wall of the cylindrical portion, the thin wall portion being pierced by the pin.

3. The snap button according to claim 2, wherein the thin wall portion includes a hole at its center.

4. The snap button according to claim 1, wherein a depression is formed at a center portion on the inner surface of the base of the button member.

5. The snap button according to claim 1, wherein the base is disk-shaped.

6. The snap button according to claim 1, wherein the engaging portion is configured to repeatedly engage with and be disengaged from the mating snap button.

* * * * *